US008434278B1

(12) United States Patent
Dueck et al.

(10) Patent No.: US 8,434,278 B1
(45) Date of Patent: May 7, 2013

(54) STORAGE BIN SUPPORT SYSTEM

(75) Inventors: Raymond Dueck, Saint Adolphe (CA); Saad Farag, Manitoba (CA)

(73) Assignee: V-Bins.com GP Inc, Morris (CA)

( * ) Notice: Subject to any disclaimer, the term of this patent is extended or adjusted under 35 U.S.C. 154(b) by 308 days.

(21) Appl. No.: 12/831,817

(22) Filed: Jul. 7, 2010

(51) Int. Cl.
*E05F 11/00* (2006.01)

(52) U.S. Cl.
USPC ..... 52/194; 52/197; 52/652.1; 52/653.1; 52/192; 220/638; 220/636; 220/635; 220/634

(58) Field of Classification Search ..... 52/194, 52/197, 652.1, 653.1, 192, 195, 196; 220/638, 220/636, 635, 634
See application file for complete search history.

(56) References Cited

U.S. PATENT DOCUMENTS

| | | | | | |
|---|---|---|---|---|---|
| 521,951 | A | * | 6/1894 | Fallis | 52/197 |
| 1,632,103 | A | * | 6/1927 | Venable | 52/194 |
| 1,715,853 | A | * | 6/1929 | Madsen | 52/64 |
| 1,742,709 | A | * | 1/1930 | Kenigsberg | 52/194 |
| 1,754,516 | A | * | 4/1930 | Johnson | 52/194 |
| 1,760,094 | A | * | 5/1930 | Tolman, Jr. | 222/502 |
| 1,913,174 | A | * | 6/1933 | Stephenson | 52/234 |
| 2,567,958 | A | * | 9/1951 | Mummert | 220/567 |
| 2,943,752 | A | * | 7/1960 | Platt | 414/323 |
| D195,828 | S | * | 8/1963 | Stapleton | D30/131 |
| 3,248,024 | A | * | 4/1966 | Keathly | 222/459 |
| 3,712,002 | A | * | 1/1973 | Hillinger et al. | 52/63 |
| 3,742,664 | A | * | 7/1973 | Reding | 52/194 |
| D235,340 | S | * | 6/1975 | Mize | D23/205 |
| D249,050 | S | | 8/1978 | Friesen | |
| 4,218,859 | A | * | 8/1980 | Sams | 52/194 |
| 4,338,752 | A | * | 7/1982 | Stanelle | 52/194 |
| 5,490,479 | A | * | 2/1996 | Shalev | 119/51.01 |
| 5,570,547 | A | * | 11/1996 | Webb et al. | 52/194 |
| 5,586,678 | A | * | 12/1996 | Rosch et al. | 220/263 |
| 8,201,520 | B2 | * | 6/2012 | Meritt | 119/53 |
| 2010/0139185 | A1 | * | 6/2010 | Neighbors | 52/194 |

* cited by examiner

*Primary Examiner* — William Gilbert
*Assistant Examiner* — Alp Akbasli
(74) *Attorney, Agent, or Firm* — Neustel Law Offices

(57) ABSTRACT

A storage bin support system for providing a leg structure to better support the storage bin and allow for easier access underneath. The storage bin support system generally includes a bin for holding the particulate material, wherein the bin includes a roof, sidewalls, and a base, and wherein the roof includes an inlet for filling the bin and wherein the base includes an outlet for emptying the bin, and a supporting framework for supporting the bin above a ground surface in an upright position, wherein supporting framework includes an outer framework and an inner framework interconnecting the outer framework with the base. The outer framework is spaced along an outer perimeter of the bin and the inner framework includes a plurality of upper angled supports comprising an upper end and optionally a plurality of lower angled supports comprising a lower end.

15 Claims, 5 Drawing Sheets

STORAGE BIN SUPPORT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a storage bin and more specifically it relates to a storage bin support system for providing a leg structure to better support the storage bin and allow for easier access underneath.

2. Description of the Related Art

Any discussion of the related art throughout the specification should in no way be considered as an admission that such related art is widely known or forms part of common general knowledge in the field.

Containers for different types of bulk goods, such as grain, have been in use for years. Typically containers include silos, hoppers, or various other types. The containers include a leg structure to support the container above the ground surface for accessing an outlet below the center of the container.

One problem with the existing leg structure includes the arrangement of the members not being optimal to support the container with the minimal amount of supports and thickness of metal. Another problem exists when emptying the container by extending an auger below the outlet opening. The leg structure, comprising horizontal members, generally interferes with the space defined for receiving the auger, thus making it difficult to extend an auger below the outlet for efficiently transferring the grain from the container. Because of the inherent problems with the related art, there is a need for a new and improved storage bin support system for providing a leg structure to better support the storage bin and allow for easier access underneath.

BRIEF SUMMARY OF THE INVENTION

A system for providing a leg structure to better support the storage bin and allow for easier access underneath. The invention generally relates to a storage bin which includes a bin for holding the particulate material, wherein the bin includes a roof, sidewalls, and a base, and wherein the roof includes an inlet for filling the bin and wherein the base includes an outlet for emptying the bin, and a supporting framework for supporting the bin above a ground surface in an upright position, wherein supporting framework includes an outer framework and an inner framework interconnecting the outer framework with the base. The outer framework is spaced along an outer perimeter of the bin and the inner framework includes a plurality of upper angled supports comprising an upper end and optionally a plurality of lower angled supports comprising a lower end.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
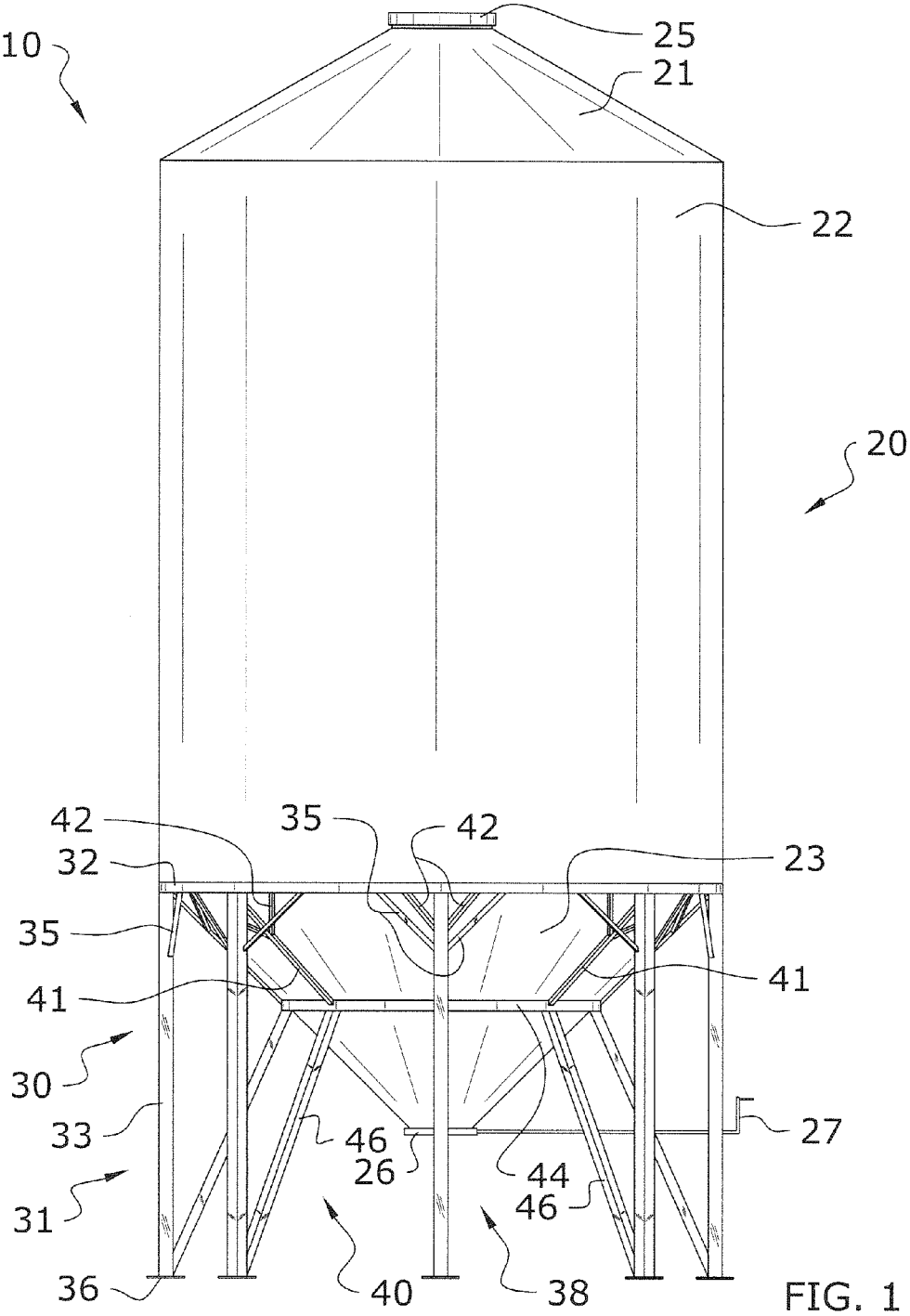
FIG. 1 is a side view of the present invention.
Figure 2:
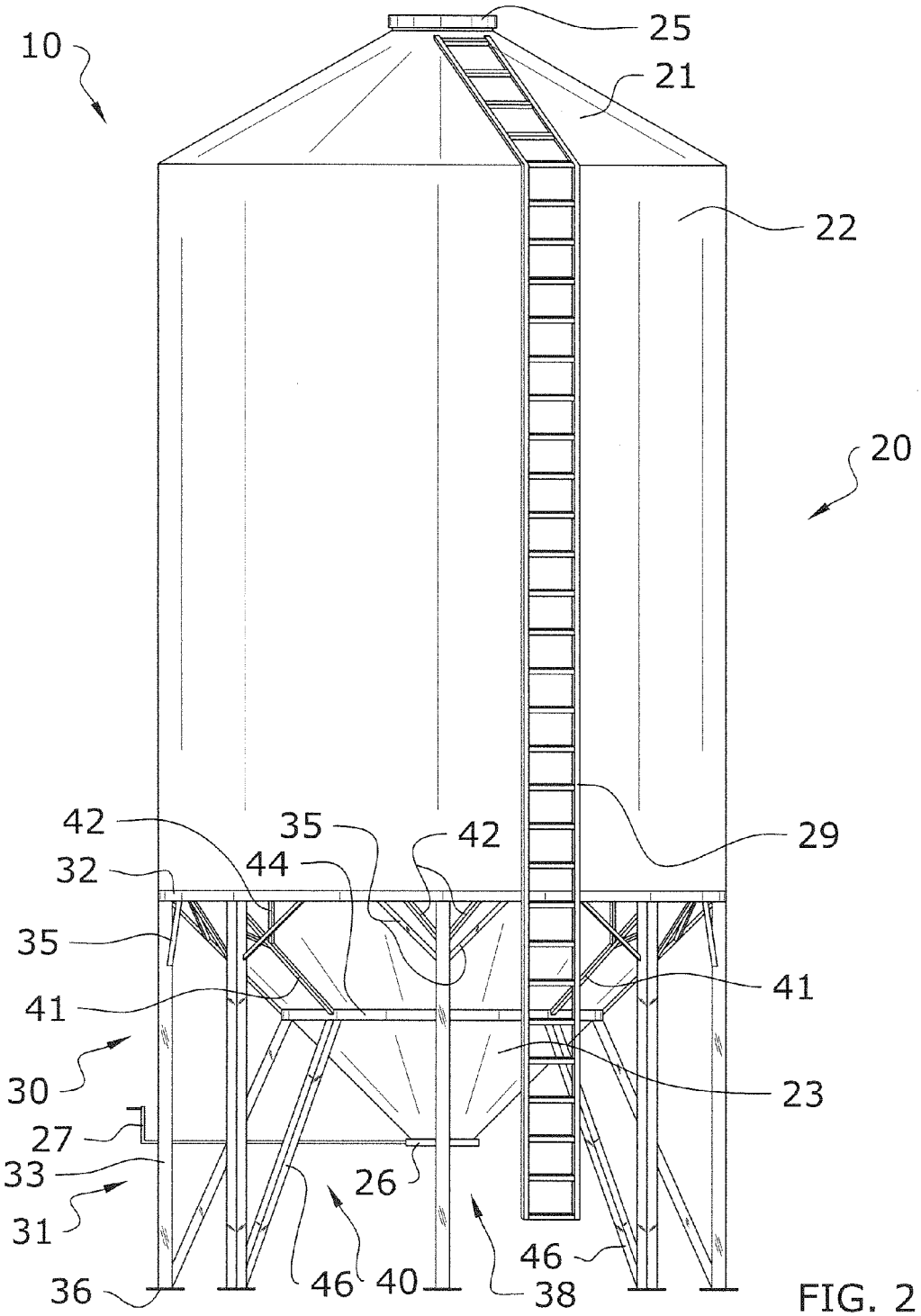
FIG. 2 is an opposite side view of the present invention.
Figure 3:
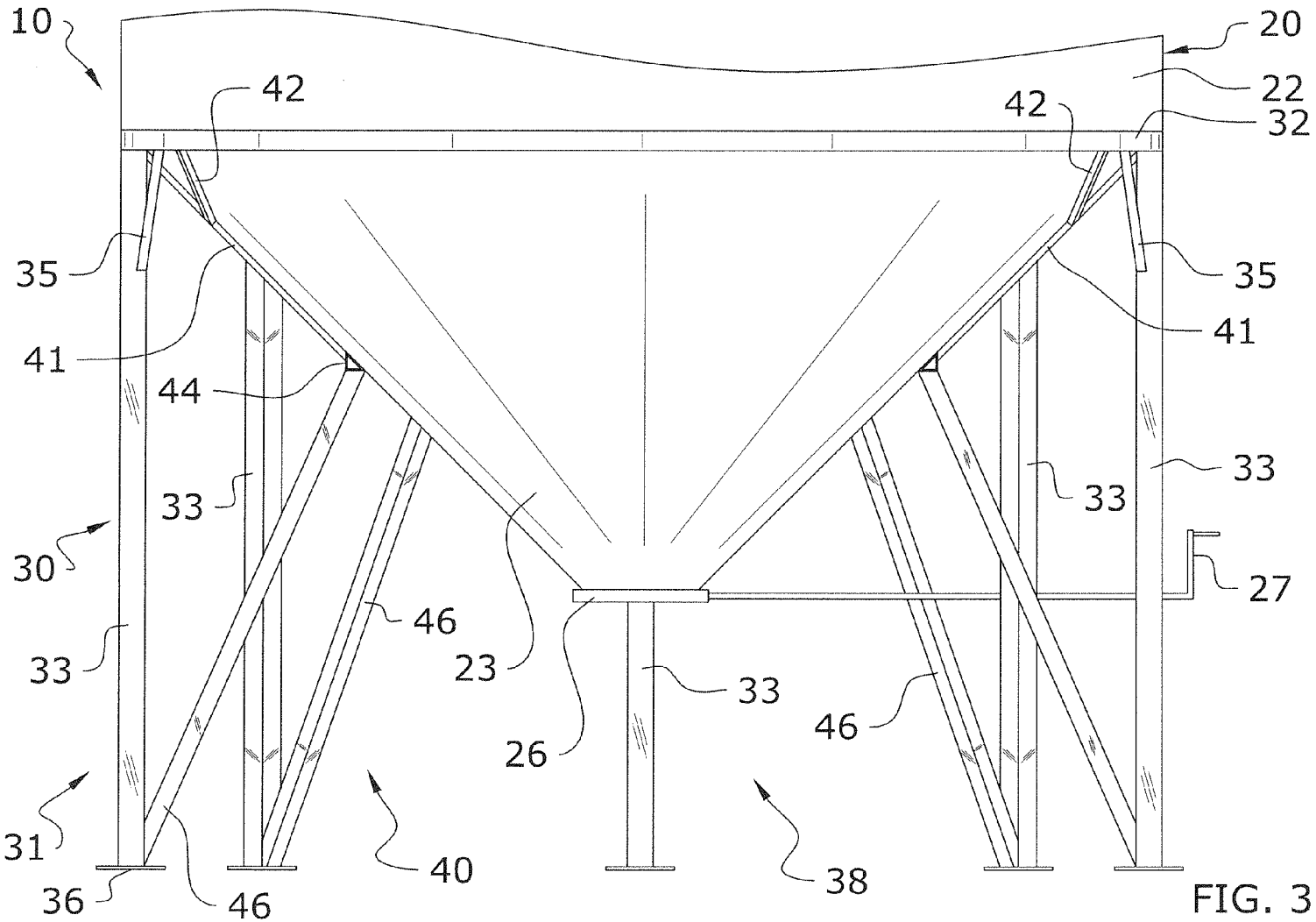
FIG. 3 is a magnified side view of the supporting framework.
Figure 4:
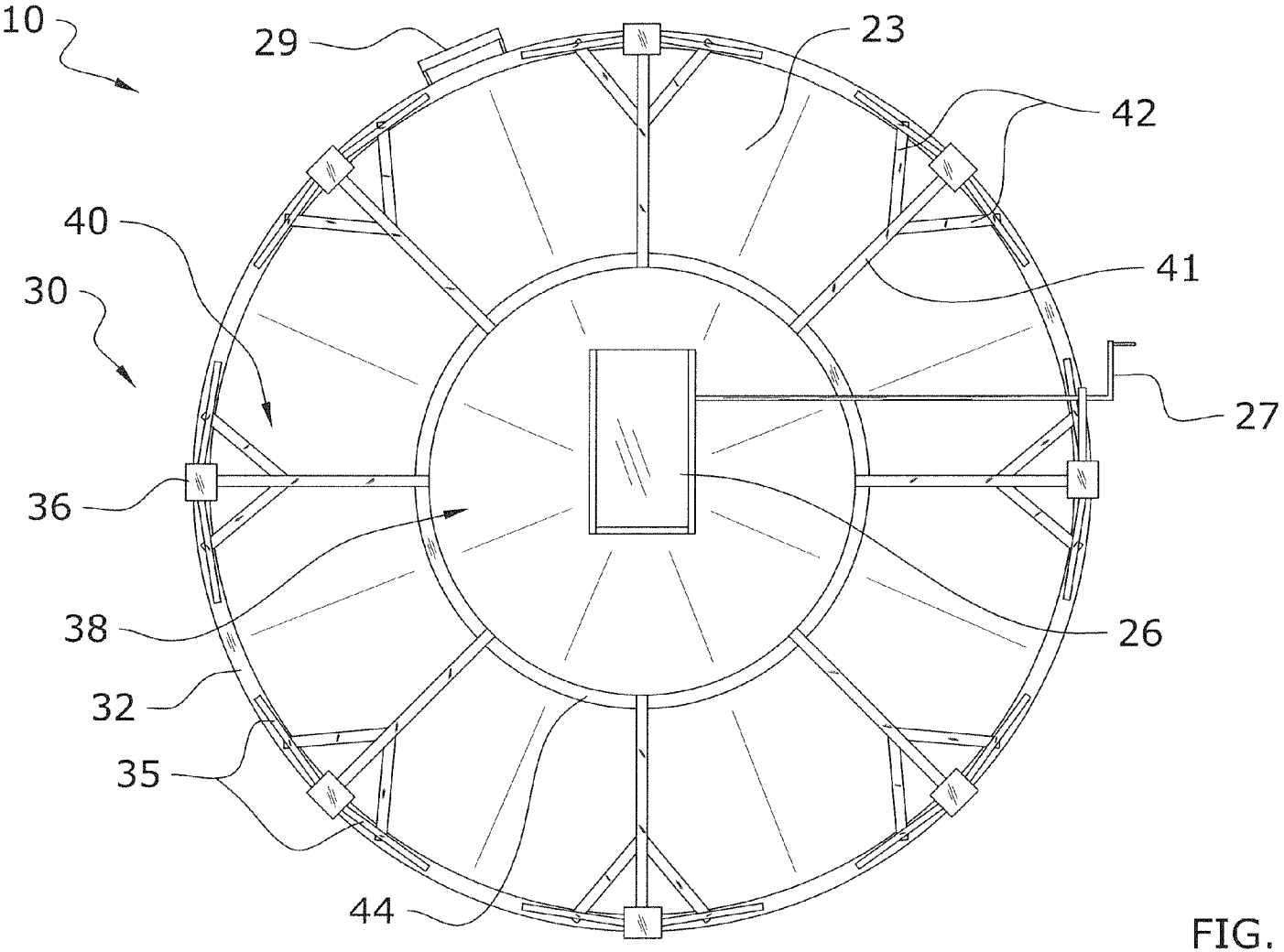
FIG. 4 is a top view of the supporting framework and base of the storage bin.
Figure 5:
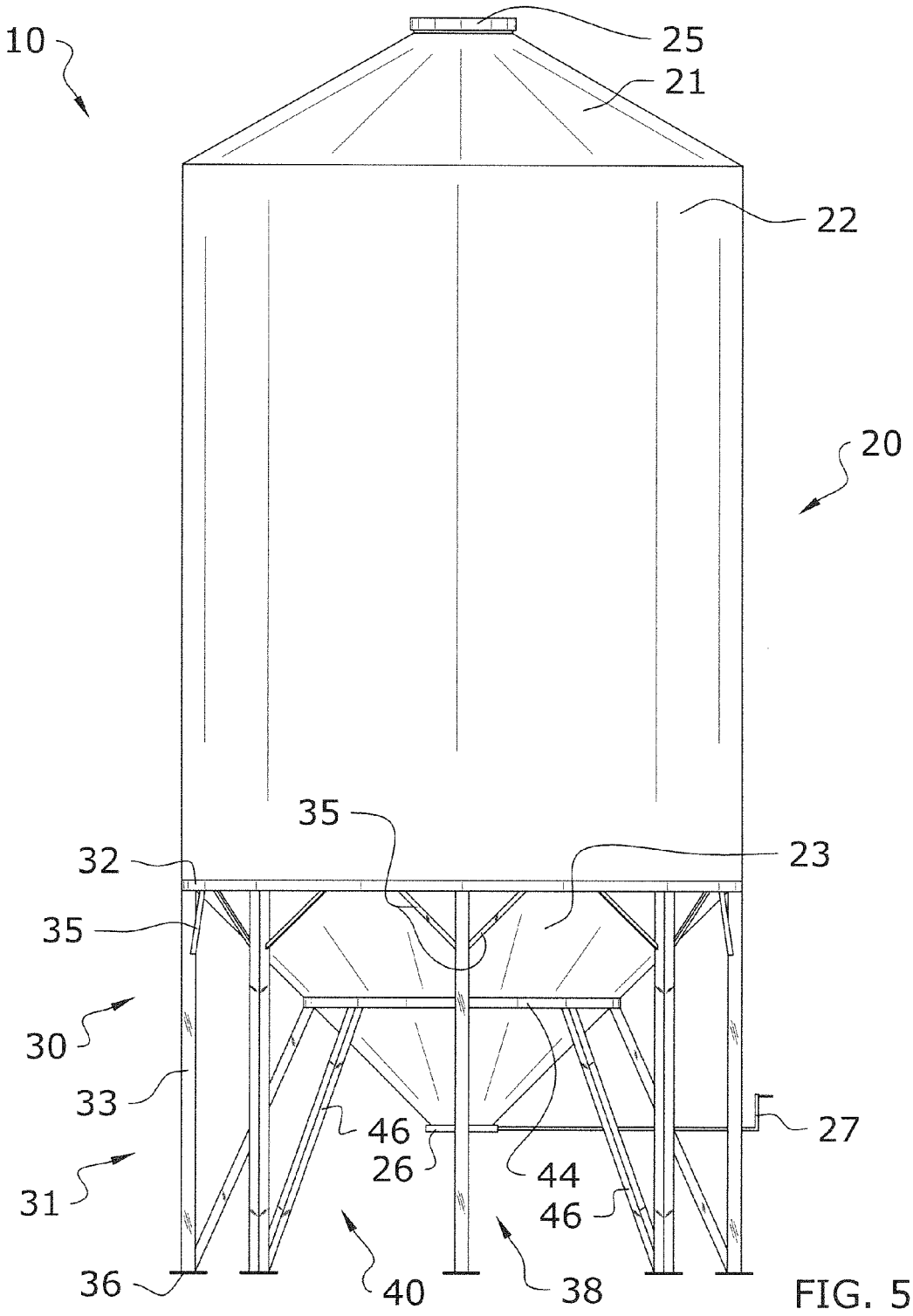
FIG. 5 is a side view of an alternate embodiment of the present invention.

Turning now descriptively to the drawings, in which similar reference characters denote similar elements throughout the several views, FIGS. 1 through 5 illustrate a storage bin support system 10, which comprises a bin 20 for holding the particulate material, wherein the bin 20 includes a roof 21, sidewalls 22, and a base 23, and wherein the roof 21 includes an inlet 25 for filling the bin 20 and wherein the base 23 includes an outlet 26 for emptying the bin 20, and a supporting framework 30 for supporting the bin 20 above a ground surface in an upright position, wherein supporting framework 30 includes an outer framework 31 and an inner framework 40 interconnecting the outer framework 31 with the base 23. The outer framework 31 is spaced along an outer perimeter of the bin 20 and the inner framework 40 includes a plurality of upper angled supports 41 comprising an upper end and a plurality of lower angled supports 46 comprising a lower end. In an alternate embodiment, as illustrated in FIG. 5, the upper angled braces 41 and the lower braces 42 are not required and thus omitted.

B. Storage Bin

The storage bin 20 is preferably used for storing a particulate material, such as various types of grain, seed, crop, or other material. However, the storage bin 20 may be used to store various other types of particulate materials or other types of materials rather than those described. The storage bin 20 is generally comprised of a large structure for holding bulk amounts of the particulate material. The storage bin 20 is also generally comprised of a self-supported structure and is supported in an upright position so as to fill the storage bin 20 from an upper end and to empty the storage bin 20 from a lower end. The storage bin 20 may be comprised of various materials, such as metal.

In the preferred embodiment, the storage bin 20 includes a roof 21 defining a generally conical shape, a cylindrical shaped sidewall 22, and a base 23 opposite the roof 21 which also defines an inverted conical shape for more precise emptying. The bin 20 is comprised of a hollow structure and may include various internal supporting members to maintain shape.

The roof 21 also generally includes an inlet 25 which is centrally located at an uppermost end for filling the storage bin 20. The inlet 25, as appreciated, may include various types of cap or cover means. A ladder 29 or other accessing means may also be located along the external side of the storage bin 20 for accessing the inlet 25 to maneuver a dumping or filling mechanism and to open and close the cover over the inlet 25.

The base 23 includes the outlet 26, which is also preferably centrally located at a lowermost end for emptying the storage bin 20. Generally, when emptying the storage bin 20, an auger end is extended below the outlet 26 of the base 23 and the particulate material is simply released through the outlet 26 onto the auger to be transferred to another location. The outlet 26 may include various types of gate assemblies 27, such as a hand crank mechanism, automatic gate, or various others to open and close the outlet 26. The base 23 may also include side openings as appreciated for faster emptying of the bin 20 or emptying in a different location or rate.

Because of the manner in emptying the storage bin 20 through the bottom of the base 23, the base 23 and storage bin 20 are preferably supported above a ground surface and a sufficient access space 38 is located thereunder for inspection purposes, as well as positioning an auger. The storage bin 20 is supported above the ground surface via the supporting framework 30 which will be described subsequently.

C. Supporting Framework

The supporting framework 30 is used to support the bin 20 above the ground surface in an upright position. The supporting framework 30 is also spaced apart to allow various entrances to the below access space 38 for positioning the auger or other transferring mechanism, and also to allow for inspection and maintenance of the bottom components of the storage bin 20. Unless otherwise noted, the supporting framework 30 is generally comprised of a substantially strong and rigid material, such as metal.

The supporting framework 30 generally includes the outer framework 31 which is positioned along an outer perimeter of the sidewall 22 and an inner framework 40, which is connected to the outer framework 31 and is generally positioned under the base 23 for providing support beneath the storage bin 20. The inner framework 40 thus extends within the access space 38 and is arranged in a manner to take up the least amount of access space 38 while providing optimal support for the base 23 and storage bin 20.

i. Outer Framework

The outer framework 31 is generally comprised of a supporting ring 32 which is positioned at a lower end of the sidewalls 22 along an intersection of the sidewalls 22 and the base 23. Extending vertically below the supporting ring 32 is a plurality of legs 33. The legs 33 are preferably vertically oriented and are spaced apart along the perimeter of the supporting ring 32 and outer perimeter of the storage bin 20. The legs 33 are adequately spaced apart to allow multiple entrances to the access space 38 beneath the base 23 of the storage bin 20.

The legs 33 are comprised of a length longer than the height of the base 23 to secure the base 23 above the ground surface. Each of the legs 33 generally include a plurality of braces 35 extending at an angle from each side of the legs 33 at an upper end. The braces 35 generally connect the upper end of the legs 33 with the outer ring 32 and form a triangular shape with the outer ring 31 and the legs 33. Each of the legs 33 also generally include a foot member 36 located at a lowermost end of the legs 33 for providing an increased surface area for the lower end of each leg 33 to provide extra stability and to prevent the legs 33 from sinking within the ground surface.

ii. Inner Framework

The inner framework 40 is positioned completely within the access space 38 beneath the storage bin 20 and inside of the outer framework 31 with respect to the access space 38 being inside of the outer framework 31 and external environment surrounding the storage bin 20 being positioned outside of the outer framework 31. The inner framework 40, being positioned within the access space 38, thus generally takes up the least amount of space as required as long as the inner framework 40 provides adequate support for the base 23 and storage bin 20.

The inner framework 40 generally interconnects the outer framework 31 with the base 23 of the storage bin 20 to provide extra support to the base 23, wherein the base 23 supports all of the particulate material within the storage bin 20. Additionally, because of the optimal supporting structure of the inner framework 40, the base 23 generally does not need to be as thick as traditional bases 23 of other grain bins 20 or hoppers.

In the preferred embodiment, the inner framework 40 includes a plurality of upper angled supports 41 which extend at an angle along the exterior of the conical shaped base 23 from the outer ring 32 towards the centrally located outlet 26. Each of the upper angled supports 41 are spaced apart from each other along the perimeter of the base 23 and each further preferably aligns with a respective leg 33 of the outer framework 31. Each of the upper angled supports 41 also preferably includes a pair of angled braces 42 forming a triangular shape with the respective upper angled support 41 and supporting ring 32 of the outer framework 31. The braces 42 and the upper angled supports 41 are each preferably attached to or run along and parallel to the exterior surface of the base 23. In an alternate embodiment, as illustrated in FIG. 5, the upper angled braces 41 and the lower braces 42 are not required and thus omitted.

Each of the upper angled supports 41 extend along the exterior surface of the base 23 to the supporting ring 44 of the inner framework 40. The supporting ring 44 of the inner framework 40 extends around the exterior of the base 23 and is circular in shape. Height wise, the inner supporting ring 44 is preferably positioned at a generally midway point between the outlet 26 along lowermost end of the base 23 and the outer supporting ring 32 along uppermost point of the base 23. The positioning of the inner supporting ring 44 substantially above the outlet 26 helps to provide available access space 38 near the outlet 26 for easily accessing the outlet 26. The inner supporting ring 44 thus is comprised of a lesser perimeter than the outer supporting ring 32.

The lower angled supports 46 extend at an angle from the inner supporting ring 44 to the lowermost end of the legs 33 of the outer framework 31. Thus, a portion of the lower angled supports 46 extend below the outlet 26 for connecting with the legs 33. The lower angled supports 46 may be directly connected to the base 23 at an upper end or indirectly connected to the base 23 through the inner supporting ring 44.

Each of the lower angled supports 46 are spaced apart from each other along the perimeter of the base 23 and each further preferably aligns with a respective leg 33 of the outer framework 31. Having the lower angled supports 46 extend at an angle rather than horizontal substantially increases the amount of available access space 38 underneath the base 23 for positioning the auger below the outlet 26. The corresponding upper angled supports 41, lower angled supports 46 and legs 33 further each form a triangular shaped connected structure.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A storage bin system for particulate material, comprising:

a bin for holding said particulate material;

wherein said bin includes a roof, sidewalls, and a base;

wherein said roof includes an inlet for filling said bin and wherein said base includes an outlet for emptying said bin; and a supporting framework for supporting said bin above a ground surface in an upright position, wherein supporting framework includes an outer framework and an inner framework interconnecting said outer framework with said base;

wherein said outer framework is spaced along an outer perimeter of said bin;

wherein said inner framework includes a plurality of lower angled supports;

wherein said inner framework includes an inner supporting ring, wherein said inner supporting ring is attached to and surrounds said base;

wherein said plurality of lower angled supports extend upwardly from said outer frame to said inner supporting ring;

wherein said outer framework includes a plurality of legs;

wherein a lower end of each of said plurality of lower angled supports is connected to a lower end of a corresponding aligned leg of said plurality of legs.

2. The storage bin system of claim 1, wherein said inner framework includes a plurality of upper angled supports comprising an upper end of said inner framework and wherein said inner supporting ring interconnects said plurality of upper angled supports and said plurality of lower angled supports.

3. The storage bin system of claim 1, wherein said inner supporting ring extends around said base substantially midway between said outlet and said sidewalls.

4. The storage bin system of claim 1, wherein an upper end of each of said plurality of lower angled supports is connected said base.

5. The storage bin system of claim 4, wherein said upper end of each of said plurality of lower angled supports is connected to a height wise midway-point of said base.

6. The storage bin system of claim 1, wherein said inner framework includes a plurality of upper angled supports comprising an upper end of said inner framework and wherein said outer framework includes a plurality of legs, wherein said plurality of legs, said plurality of upper angled supports and said plurality of lower angled supports define a triangular shaped structure.

7. A storage bin system for particulate material, comprising:

a bin for holding said particulate material;

wherein said bin includes a roof, sidewalls, and a base;

wherein said roof includes an inlet for filling said bin and wherein said base includes an outlet for emptying said bin; and a supporting framework for supporting said bin above a ground surface in an upright position, wherein supporting framework includes an outer framework and an inner framework interconnecting said outer framework with said base;

wherein said outer framework is spaced along an outer perimeter of said bin;

wherein said inner framework includes a plurality of lower angled supports;

wherein said inner framework includes an inner supporting ring, wherein said inner supporting ring is attached to and surrounds said base;

wherein said inner framework includes a plurality of upper angled supports comprising an upper end of said inner framework and wherein said inner supporting ring interconnects said plurality of upper angled supports and said plurality of lower angled supports;

wherein said plurality of lower angled supports extend upwardly from said outer frame to said inner supporting ring.

8. The storage bin system of claim 7, wherein said inner supporting ring extends around said base substantially midway between said outlet and said sidewalls.

9. The storage bin system of claim 7, wherein said outer framework includes a plurality of legs.

10. The storage bin system of claim 9, wherein a lower end of each of said plurality of lower angled supports is connected to a lower end of a corresponding leg of said plurality of legs.

11. The storage bin system of claim 10, wherein an upper end of each of said plurality of lower angled supports is connected said base.

12. The storage bin system of claim 11, wherein said upper end of each of said plurality of lower angled supports is connected to a height wise midway-point of said base.

13. The storage bin system of claim 7, wherein said inner framework includes a plurality of upper angled supports comprising an upper end of said inner framework and wherein said outer framework includes a plurality of legs, wherein said plurality of legs, said plurality of upper angled supports and said plurality of lower angled supports define a plurality of triangular shaped structures.

14. The storage bin system of claim 7, wherein said outer framework includes an outer supporting ring having a perimeter substantially similar to said sidewalls and wherein said inner framework includes an inner supporting ring having a perimeter substantially similar to a height wise midway-point of said base.

15. A storage bin system for particulate material, comprising:

a bin for holding said particulate material;

wherein said bin includes a roof, sidewalls, and a base;

wherein said roof is comprised of a conical shaped structure;

wherein said base is comprised of an inverted conical shaped structure;

wherein said sidewalls are comprised of a cylindrical shaped structure;

wherein said roof includes an inlet for filling said bin and wherein said base includes an outlet for emptying said bin;

wherein said bin includes a ladder;

wherein said bin include a gate assembly for opening and closing said outlet; and a supporting framework for supporting said bin above a ground surface in an upright position;

wherein supporting framework includes an outer framework and an inner framework interconnecting said outer framework with said base;

wherein said outer framework is spaced along an outer perimeter of said bin;

wherein said outer framework includes an outer supporting ring having a perimeter substantially similar to said sidewalls;

wherein said outer supporting ring is positioned at an intersecting point of said sidewalls and said base;

wherein said outer framework includes a plurality of legs extending vertically downward from said outer supporting ring;

wherein said outer framework includes a plurality of outer braces interconnecting said plurality of legs and said outer supporting ring adjacent an upper end of said plurality of legs;

wherein said outer framework includes a foot members positioned upon a lower end of said plurality of legs;

wherein said inner framework includes an inner supporting ring having a perimeter substantially similar to a height wise midway-point of said base;

wherein said inner supporting ring is attached to said base;

wherein said inner framework includes a plurality of upper angled supports comprising an upper end of said inner framework;

wherein said upper angled supports extend along said base between said outer supporting ring and said inner supporting ring;

wherein said inner framework includes a plurality of inner braces interconnecting said plurality of upper angled supports and said outer supporting ring adjacent an upper end of said plurality of upper angled supports;

wherein said inner framework includes a plurality of lower angled supports comprising a lower end of said inner framework;

wherein said plurality of lower angled supports are interconnected between said inner supporting ring and said lower end of said plurality of legs;

wherein a portion of said plurality of lower angled supports extends below said outlet for connecting with said lower end of said plurality of legs;

wherein said plurality of legs, said plurality of upper angled supports and said plurality of lower angled supports define a plurality of triangular shaped structures.

* * * * *